US009091144B2

(12) United States Patent
Swanson et al.

(10) Patent No.: US 9,091,144 B2
(45) Date of Patent: Jul. 28, 2015

(54) ENVIRONMENTALLY POWERED TRANSMITTER FOR LOCATION IDENTIFICATION OF WELLBORES

(75) Inventors: Aaron R. Swanson, Houston, TX (US); Elton Frost, Jr., Spring, TX (US); James P. Dwyer, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 574 days.

(21) Appl. No.: 13/428,924

(22) Filed: Mar. 23, 2012

(65) Prior Publication Data

US 2013/0248169 A1 Sep. 26, 2013

(51) Int. Cl.
*E21B 43/00* (2006.01)
*E21B 41/00* (2006.01)

(52) U.S. Cl.
CPC ..... *E21B 41/0085* (2013.01)

(58) Field of Classification Search
CPC . E21B 43/2401; E21B 36/04; E21B 41/0085; E21B 41/00; H02N 2/18; H02N 1/08; H02N 11/002
USPC ..... 166/65.1, 177.6, 244.1, 248, 302; 310/339, 12.04; 175/93
See application file for complete search history.

(56) References Cited

U.S. PATENT DOCUMENTS 3,876,471 A * 4/1975 Jones ..... 175/93
5,099,918 A * 3/1992 Bridges et al. ..... 166/60
5,965,964 A * 10/1999 Skinner et al. ..... 310/15
6,011,346 A * 1/2000 Buchanan et al. ..... 310/339
6,253,847 B1 * 7/2001 Stephenson ..... 166/248
6,504,258 B2 * 1/2003 Schultz et al. ..... 290/1 R
6,554,074 B2 * 4/2003 Longbottom ..... 166/372
6,717,283 B2 * 4/2004 Skinner et al. ..... 290/43
7,647,979 B2 1/2010 Shipley et al.
7,951,286 B2 * 5/2011 Dwars et al. ..... 205/730
2005/0051323 A1 * 3/2005 Fripp et al. ..... 166/65.1
2006/0086498 A1 4/2006 Wetzel et al.
2009/0101341 A1 * 4/2009 Willauer ..... 166/250.15
2010/0219646 A1 * 9/2010 Hay ..... 290/1 A
2011/0049901 A1 * 3/2011 Tinnen et al. ..... 290/54
2011/0148656 A1 * 6/2011 Hudson et al. ..... 340/854.3
2013/0110402 A1 * 5/2013 Godager ..... 702/7
2013/0248169 A1 * 9/2013 Swanson et al. ..... 166/244.1
2014/0320301 A1 * 10/2014 Hudson ..... 340/854.4

FOREIGN PATENT DOCUMENTS

GB 2433753 A 7/2007

OTHER PUBLICATIONS

Dickey, Parke A.; "Natural Potentials in Sedimentary Rocks," Transactions of the A.I.M.E., vol. 155, 1944, pp. 39-48.
Doll, H. G.; "The S.P. Log: Theoretical Analysis and Principles of Interpretation," Society of Petroleum Engineers, 949146-G, vol. 179, No. 1, Dec. 1949, pp. 146-185.
(Continued)

*Primary Examiner* — Daniel P Stephenson
(74) *Attorney, Agent, or Firm* — Cantor Colburn LLP

(57) ABSTRACT

A method, apparatus and system for performing an operation in a borehole is disclosed. A device is disposed in a downhole environment of the borehole to perform the downhole operation. An energy harvesting unit coupled to the device harvests energy from an energy source in a downhole environment of the device and provides the harvested energy to the device to perform the downhole operation.

24 Claims, 3 Drawing Sheets

(56) References Cited

OTHER PUBLICATIONS

Doll, H. G.; "The SP Log iin Shaly Sands," T.P. 2912, vol. 189, 1950, pp. 205-214.

Mounce, W. D. et al.; "Natural Potentials in Well Logging," Transactions of the A.I.M.E., vol. 155, 1944, pp. 49-57.

Samuel, Robello; E&P, "Harvesting wasted energy downhole," Feb. 4, 2006, http://www.epmag.com/archives/techWatch/4268.htm, pp. 1-4.

* cited by examiner

ENVIRONMENTALLY POWERED TRANSMITTER FOR LOCATION IDENTIFICATION OF WELLBORES

BACKGROUND OF THE DISCLOSURE

1. Field of the Disclosure

The present disclosure relates to methods and apparatus for powering a downhole device using energy harvested from an environment of the device.

2. Description of the Related Art

Various downhole operations utilize electrical devices in a wellbores to perform a variety of functions. One difficulty with such operations has to do with providing power to the downhole devices over long deployment times. It is generally cost-effective to provide a local energy source such as a battery to power the device. Such energy sources, however, tend to run down before the deployment time of the device is over. Therefore, it is desirable to have apparatus and methods for recharging such local energy sources and for directly providing power to operate downhole electrical devices. The present disclosure provides apparatus and methods for harnessing or harvesting electrical power from subsurface environment and provide same to downhole electrical devices.

SUMMARY OF THE DISCLOSURE

In one aspect, the present disclosure provides a method of performing an operation in a wellbore, including: disposing a device in a downhole environment of the wellbore; harvesting energy from an energy source in the downhole environment; and using the harvested energy to power the device in the wellbore to perform the operation.

In another aspect, the present disclosure provides an apparatus for performing a downhole operation, the apparatus including: a device disposed downhole configured to perform the downhole operation; and an energy harvesting unit coupled to the device configured to harvest energy from an energy source in a downhole environment of the device and to provide the harvested energy to the device to perform the downhole operation.

In yet another aspect, the present disclosure provides a completion system, including: a casing disposed in a wellbore; a device disposed in the wellbore proximate the casing configured to perform a downhole operation; and an energy harvesting unit disposed in the wellbore coupled to the device configured to harvest energy from an energy source in a downhole environment of the device and to provide the harvested energy to the device to perform the downhole operation.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DETAILED DESCRIPTION OF THE DISCLOSURE

Figure 1:
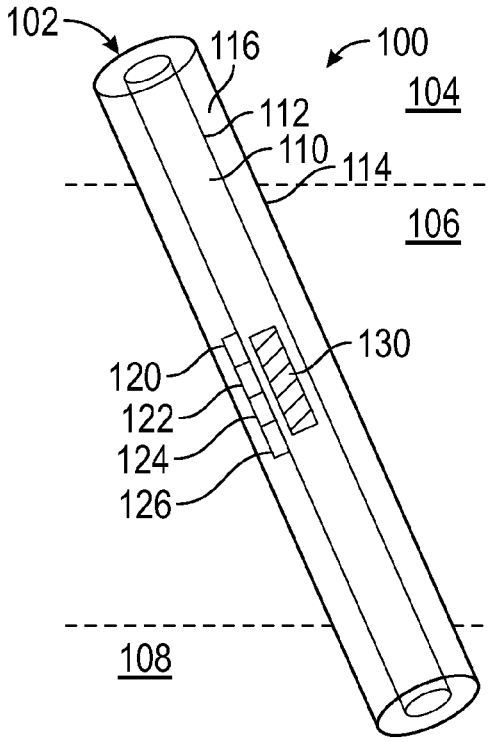
FIG. 1 shows an exemplary completion system suitable for performing an operation in a wellbore using the exemplary methods described herein.

FIG. 1 shows an exemplary completion system 100 suitable for performing an operation in a wellbore using the exemplary methods described herein. The system in one embodiment includes a casing 112 disposed in a wellbore 102 penetrating a plurality of formations 104, 106 and 108. The casing 112 defines an internal axial flowbore 110 and is typically separated from a wall 114 of the wellbore 102 by an annulus 116. One or more devices may be disposed in the annulus 116 between the casing 112 and wellbore wall 114. The one or more devices may include a device 120 that performs the exemplary operation in the wellbore, a control unit 122, an energy storage unit 124 for storing energy and an energy harvesting unit 126 for harvesting energy from an energy source in an environment surrounding the device. In one aspect, the energy harvesting unit 126 is configured to harvest energy from natural environmental sources such as a surrounding formation of formations. Formation energy may include, for example, electrochemical energy and/or radiation energy of the surrounding formations. Alternatively, the energy harvesting unit 126 may harvest electromagnetic energy resulting from operation of a downhole instrument or from an operation for cathodic corrosion protection of the casing 112. Various methods for coupling the energy harvesting unit 126 to the formation are contemplated within the present disclosure. In one embodiment, the energy harvesting unit 126 may be directly attached to the formation. In an alternate embodiment, the energy harvesting unit may be coupled to a swellable packer or an extendable component of a casing to bring the energy harvesting unit into contact with the formation. In various embodiments, energy harvesting unit 126 supplies the harvested energy directly to the operational device 120 or to an energy storage unit 124 for storage. In one embodiment, energy stored from the harvesting unit 126 at the energy storage unit 124 may then be used at device 120 at a later time. As described with respect to FIG. 2, the control unit 122 may control various functions related to the operation of the device 120 and/or to the harvesting of energy from the formations as described with respect to FIG. 2. In various embodiments, the control unit transmits and receives command signals and/or data to a master control unit 130 that may be disposed in the wellbore 102 or in a secondary wellbore. The control unit 122 may perform various operations using a program running at the control unit or in response to receipt of a command signal from the master control unit 130.

Figure 2:
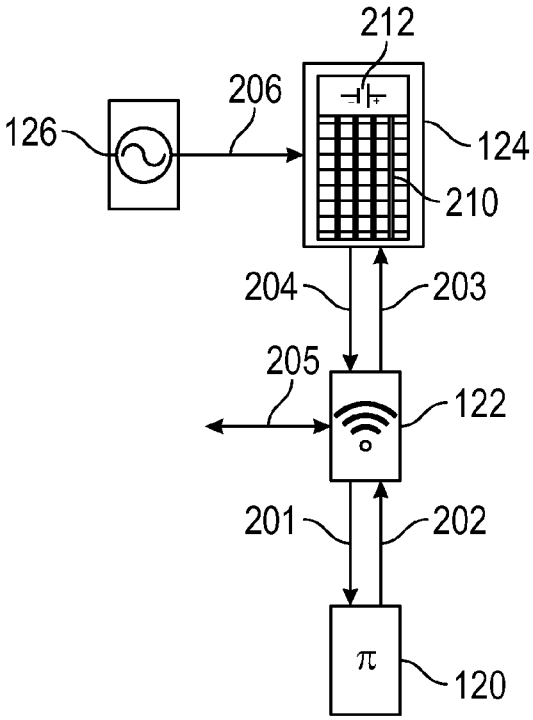
FIG. 2 shows a schematic view of the various downhole components for harvesting energy and powering a downhole device in an exemplary embodiment of the present disclosure.

FIG. 2 shows a schematic view of the various downhole components for harvesting energy and powering a downhole device in an exemplary embodiment of the present disclosure. In various embodiments, device 120 may be a sensor suitable for measuring a property of a formation, a property of a casing, a property of a wellbore and/or a property of an annulus. The device 120 may also transmit a signal that may indicate wellbore location or an identification signal. Control unit 122 is coupled to the device 120 and may transmit a signal 201 and/or receive a signal 202 from the device 120. The signal 201 may be energy transmitted to the device for powering an operation of the device. Signal 201 may alternatively be a command signal for controlling an operation of the device, such as waking the device from a "sleep" state, initiating operation of the device, initiating data acquisition at the device or controlling a measurement sequence at the device, for example. Signal 202 may be, for example, data or measurements obtained at device 120. The control unit may store the data of measurements or alternately may transmit the data or measurements to a remote location. Energy harvesting unit 126 harvests energy from an environment surrounding the device. The harvesting unit 126 stores the harvested energy 206 at the energy storage unit 124. In various embodiments, the energy storage unit 124 includes a mesh of capacitors 210 and a rechargeable energy source 212 such as a rechargeable battery. The energy harvested by the harvesting unit may be used to accumulate a charge or voltage at the mesh of capacitors 210 using the harvested energy. In typical embodiments, the harvested energy is used to obtain or produce an electrical current at the harvesting unit. The electrical current is used to accumulate a charge or voltage at the mesh of capacitors 210. When the charge or voltage at the mesh of capacitors reaches a selected value, the capacitors may be discharged and their energy stored at the rechargeable energy source 212. In one embodiment, the control unit 122 draws the stored energy 204 from the energy storage unit 124 to power the device 120. The control unit may also communicate signals 203 and 204 to and from the energy storage unit 124, for example, to monitor an energy storage level of the energy storage unit 124 as well as to control a transfer of energy from the energy storage unit 124 to the device 120. The control unit may 122 may further communicate with a device at an external location over channel 205. In one aspect, the control unit 122 may communicate with master control module 130 to receive a command and control a downhole operation according to the received command.

Figure 3:
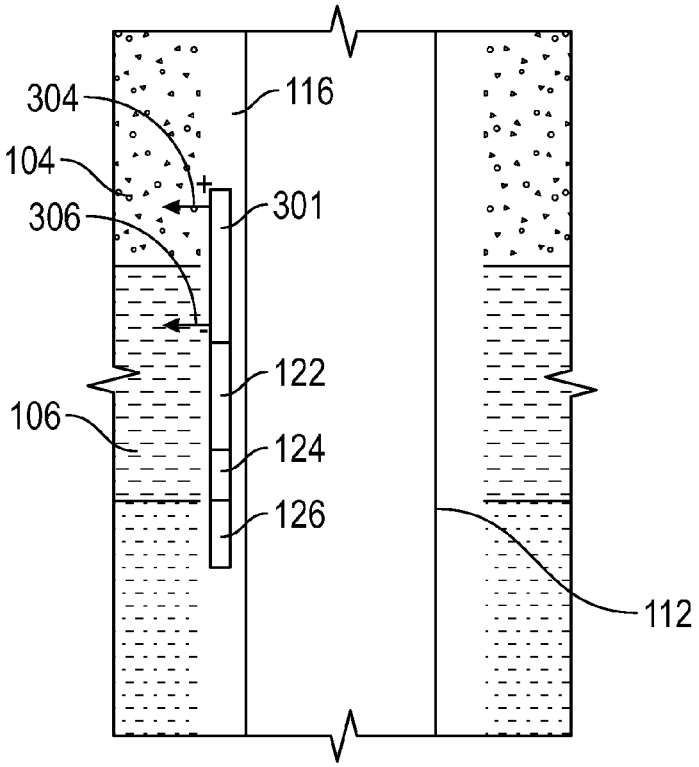
FIG. 3 shows an exemplary embodiment of an energy harvesting unit for harvesting an electrochemical energy from a surrounding formation.

FIG. 3 shows an exemplary embodiment of an energy harvesting unit 301 for harvesting an electrochemical energy from a surrounding formation. The electrochemical harvesting unit 301, device 120, energy storage unit 122 and control unit 124 are shown in the annular region 116 between the casing 112 and the formation 104 and 106. In an exemplary embodiment, the first formation 104 may include a shale or clay formation that is generally non-porous and non-saline and the second formation 106 may include a sand or conductive formation that generally includes a saline component. Additionally, formations having differing levels of salinity may be used. The electrochemical harvesting unit 301 includes at least a first electrode 304 and a second electrode 306. The first electrode 304 is coupled to the first formation layer 104 and the second electrode 306 is coupled to the second formation layer 106. The harvesting unit therefore provides a conductive path between the two layers. An electrical current flows through the conductive path of the electrochemical harvesting unit 301 due to electrochemical differences between the exemplary formations 104 and 106. The electrical current is used to charge the mesh of capacitors 210 of the energy storage unit 124 to recharge the rechargeable energy source 212 using the exemplary methods discussed herein.

Figure 4:
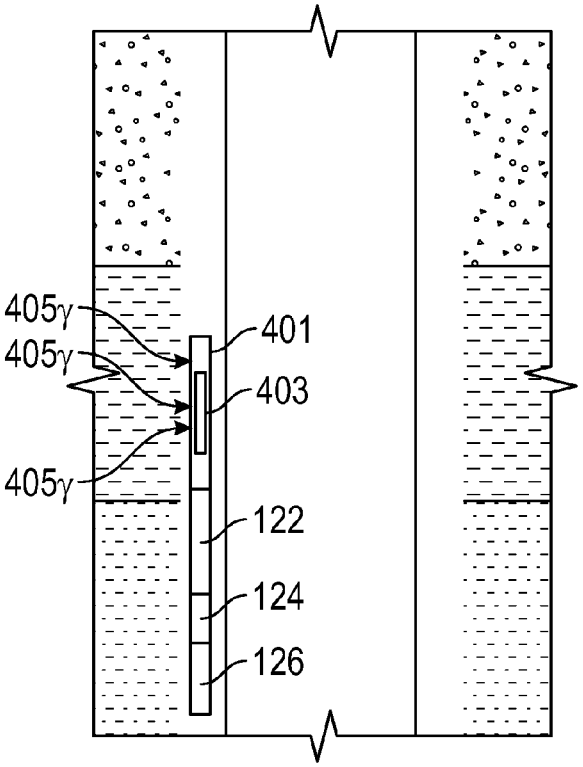
FIG. 4 shows another embodiment of the present disclosure in which radiothermic energy is harvested from a surrounding formation.

FIG. 4 shows another embodiment of the present disclosure in which radiothermic energy is harvested from a surrounding formation. Formations such as ash beds may be a supply of radiothermic energy. A radiothermic energy harvesting unit 401 in one embodiment may include a scintillation detector 403, such as a Sodium Iodide (NaI) detector, reactive to natural radiation 405 from the surrounding formation. The scintillation detector receives the radiation 405 from radioactive decay of radioactive elements naturally found in the formations, and produces an electrical current in response to the received radiation. The produced electrical current charges the mesh of capacitors 210 for energy storage at the energy storage unit 124 using the exemplary methods discussed herein.

Figure 5:
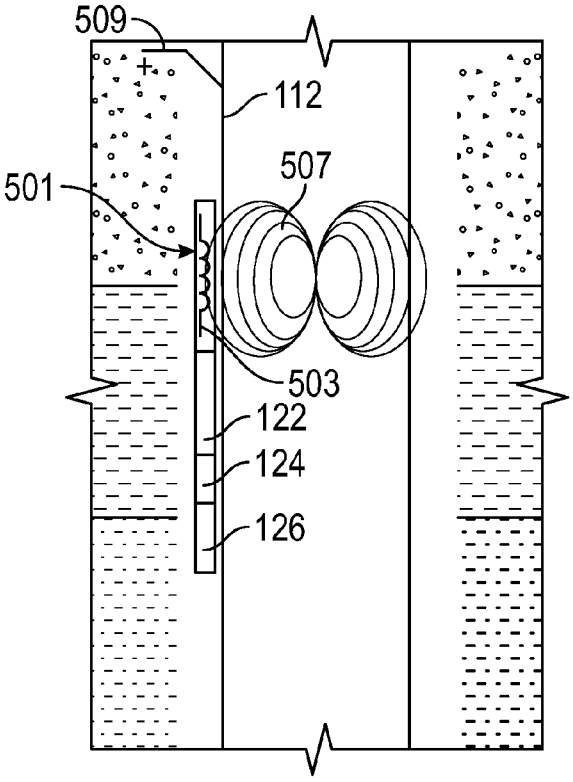
FIGS. 5 and 6 show energy harvesting units configured to harvest electromagnetic energy from operations occurring in the wellbore.
Figure 6:
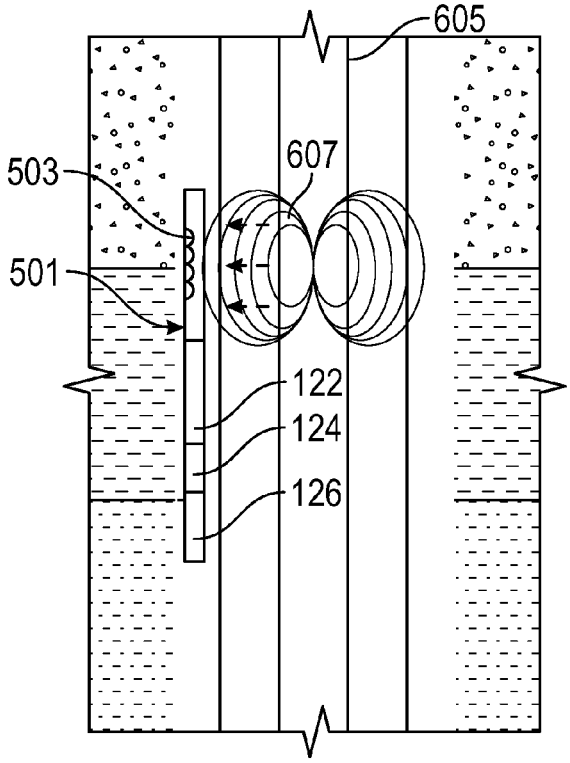

FIG. 5 and FIG. 6 shows an energy harvesting unit configured to harvest electromagnetic energy from an operation in the wellbore. The energy harvesting unit 501 includes an induction coil 503 for receiving electromagnetic radiation energy. FIG. 6 shows an energy harvesting unit 501 harvesting electromagnetic energy from a cathodic protection of casing 112 in the wellbore. Typical corrosion prevention involves applying a voltage to the casing, which can be a DC or AC voltage. Cathodic power source 509 generates the AC voltage. The casing 112 transmits an electromagnetic field 507 due to fluctuations in the AC voltage at the casing. The transmitted electromagnetic field 507 in turn induces an electrical current at the energy harvesting unit 501. The received electromagnetic radiation induces an electric current in the induction coil which is therefore used to charge the mesh of capacitors in order to for recharging the rechargeable battery unit 124 using the exemplary methods discussed herein.

In FIG. 6, the energy harvesting unit 501 harvests energy from a wellbore instrument operating at a nearby location. Operation of the wellbore instrument 605 produced an electromagnetic field 607 which is received at the energy harvesting unit 501. The received electromagnetic field induces an electric current in the induction coil 503. The electric current charges the mesh of capacitors for recharging the rechargeable battery unit 124 using the exemplary methods discussed herein.

Therefore, in one aspect, the present disclosure provides a method of performing an operation in a wellbore, including: disposing a device in a downhole environment of the wellbore; harvesting energy from an energy source in the downhole environment; and using the harvested energy to power the device in the wellbore to perform the operation. In various embodiments, the energy source in the downhole environment further comprises one selected from the group consisting of: (i) a formation surrounding the wellbore; (ii) a casing in the wellbore; and (iii) an electrical instrument operating in the wellbore. In one embodiment, harvesting energy includes coupling a first electrode to a first formation layer having a first electrochemical potential and coupling a second electrode to a second formation layer having a second electrochemical potential different from the first electrochemical potential to obtain a current. In another embodiment, harvesting energy includes obtaining an electric current in response to radiation received from a formation. In yet other embodiments, harvesting energy includes inducing an electric current in response to an electromagnetic field resulting from at least one of: (i) a cathodic protection operation for a casing in the wellbore; and (ii) operation of an electrical instrument in the wellbore. The harvested energy may be stored at an energy storage unit in the wellbore. To store the harvested energy, at least one capacitor is charged using the harvested energy and discharged store the energy at a rechargeable energy source of the energy storage unit.

In another aspect, the present disclosure provides an apparatus for performing a downhole operation, the apparatus including: a device disposed downhole configured to perform the downhole operation; and an energy harvesting unit coupled to the device configured to harvest energy from an energy source in a downhole environment of the device and to provide the harvested energy to the device to perform the downhole operation. In various embodiments, the energy harvesting unit is configured to harvest energy from one selected from the group consisting of: (i) a formation surrounding the wellbore; (ii) a casing in the wellbore; and (iii) an electrical instrument operating in the wellbore. In one embodiment, the energy harvesting unit includes a first electrode configured to couple to a first formation layer having a first electrochemical potential and a second electrode configured to couple to a second formation layer having a second electrochemical potential different from the first electrochemical potential to obtain a current at the energy harvesting unit. In another embodiment, the energy harvesting unit includes a detector configured to receive radiation from a formation and produce an electric current in response to the received radiation. In yet other embodiments, the energy harvesting unit includes an induction coil configured to produce an electric current induced by an electromagnetic field resulting from at least one of: (i) a cathodic protection operation for a casing in the wellbore; and (ii) operation of an electrical instrument in the wellbore. The apparatus may also include an energy storage unit configured to store the harvested energy in the wellbore. Such an energy storage unit may include: (i) at least one capacitor configured to accumulate a charge using the harvested energy, and (ii) a rechargeable energy source, wherein the at least one capacitor is further configured to discharge to recharge the rechargeable energy source.

In yet another aspect, the present disclosure provides a completion system, including: a casing disposed in a wellbore; a device disposed in the wellbore proximate the casing configured to perform a downhole operation; and an energy harvesting unit disposed in the wellbore coupled to the device configured to harvest energy from an energy source in a downhole environment of the device and to provide the harvested energy to the device to perform the downhole operation. In various embodiments, the energy harvesting unit is configured to harvest energy from one selected from the group consisting of: (i) a formation surrounding the wellbore; (ii) a casing in the wellbore; and (iii) an electrical instrument operating in the wellbore. In one embodiment, the energy harvesting unit includes a first electrode configured to couple to a first formation layer having a first electrochemical potential and a second electrode configured to couple to a second formation layer having a second electrochemical potential different from the first electrochemical potential to obtain a current at the energy harvesting unit. In another embodiment, the energy harvesting unit includes a detector configured to receive radiation from a formation and produce an electric current in response to the received radiation. In other embodiments, the energy harvesting unit includes an induction coil configured to produce an electric current induced by an electromagnetic field resulting from at least one of: (i) a cathodic protection operation for a casing in the wellbore; and (ii) operation of an electrical instrument in the wellbore. The completion system may further include an energy storage unit that includes: (i) at least one capacitor configured to accumulate a charge using the harvested energy, and (ii) a rechargeable energy source, wherein the at least one capacitor is further configured to recharge the rechargeable energy source.

While the foregoing disclosure is directed to the certain exemplary embodiments of the disclosure, various modifications will be apparent to those skilled in the art. It is intended that all variations within the scope and spirit of the appended claims be embraced by the foregoing disclosure.

The invention claimed is:

1. A method of performing an operation in a wellbore, comprising:

disposing a device in a downhole environment of the wellbore;

harvesting energy from an energy source in the downhole environment by coupling a first electrode to a first formation layer having a first electrochemical potential and coupling a second electrode to a second formation layer having a second electrochemical potential different from the first electrochemical potential to obtain a current; and using the harvested energy to power the device in the wellbore to perform the operation.

2. The method of claim 1, further comprising storing the harvested energy at an energy storage unit in the wellbore.

3. The method of claim 1, wherein storing the harvested energy further comprises charging at least one capacitor using the harvested energy and discharging the at least one capacitor to store the energy at a rechargeable energy source of the energy storage unit.

4. A method of performing an operation in a wellbore, comprising:

disposing a device in a downhole environment of the wellbore;

harvesting energy from an energy source in the downhole environment by obtaining an electric current in response to radiation received from a formation; and using the harvested energy to power the device in the wellbore to perform the operation.

5. The method of claim 4, further comprising storing the harvested energy at an energy storage unit in the wellbore.

6. The method of claim 5, wherein storing the harvested energy further comprises charging at least one capacitor using the harvested energy and discharging the at least one capacitor to store the energy at a rechargeable energy source of the energy storage unit.

7. A method of performing an operation in a wellbore, comprising:

disposing a device in a downhole environment of the wellbore;

harvesting energy from an energy source in the downhole environment by inducing an electric current in response to an electromagnetic field resulting from at least one of: (i) a cathodic protection operation for a casing in the wellbore; and (ii) operation of an electrical instrument in the wellbore; and using the harvested energy to power the device in the wellbore to perform the operation.

8. The method of claim 7, further comprising storing the harvested energy at an energy storage unit in the wellbore.

9. The method of claim 8, wherein storing the harvested energy further comprises charging at least one capacitor using the harvested energy and discharging the at least one capacitor to store the energy at a rechargeable energy source of the energy storage unit.

10. An apparatus for performing a downhole operation, comprising:

a device disposed downhole configured to perform the downhole operation; and an energy harvesting unit coupled to the device configured to harvest energy from an energy source in a downhole environment of the device and to provide the harvested energy to the device to perform the downhole operation, wherein the energy harvesting unit further comprises a first electrode configured to couple to a first formation layer having a first electrochemical potential and a second electrode configured to couple to a second formation layer having a second electrochemical potential different from the first electrochemical potential to obtain a current at the energy harvesting unit.

11. The apparatus of claim 10, further comprising an energy storage unit configured to store the harvested energy in the wellbore.

12. The apparatus of claim 11, wherein the energy storage unit further comprises:

(i) at least one capacitor configured to accumulate a charge using the harvested energy, and (ii) a rechargeable energy source, wherein the at least one capacitor is further configured to recharge the rechargeable energy source.

13. An apparatus for performing a downhole operation, comprising:

a device disposed downhole configured to perform the downhole operation; and an energy harvesting unit coupled to the device configured to harvest energy from an energy source in a downhole environment of the device and to provide the harvested energy to the device to perform the downhole operation, wherein the energy harvesting unit further comprises a detector configured to receive radiation from a formation and produce an electric current in response to the received radiation.

14. The apparatus of claim 13, further comprising an energy storage unit configured to store the harvested energy in the wellbore.

15. The apparatus of claim 14, wherein the energy storage unit further comprises:

(i) at least one capacitor configured to accumulate a charge using the harvested energy, and (ii) a rechargeable energy source, wherein the at least one capacitor is further configured to recharge the rechargeable energy source.

16. An apparatus for performing a downhole operation, comprising:

a device disposed downhole configured to perform the downhole operation; and an energy harvesting unit coupled to the device configured to harvest energy from an energy source in a downhole environment of the device and to provide the harvested energy to the device to perform the downhole operation, wherein the energy harvesting unit further comprises an induction coil configured to produce an electric current induced by an electromagnetic field resulting from at least one of: (i) a cathodic protection operation for a casing in the wellbore; and (ii) operation of an electrical instrument in the wellbore.

17. The apparatus of claim 16, further comprising an energy storage unit configured to store the harvested energy in the wellbore.

18. The apparatus of claim 17, wherein the energy storage unit further comprises:

(i) at least one capacitor configured to accumulate a charge using the harvested energy, and (ii) a rechargeable energy source, wherein the at least one capacitor is further configured to recharge the rechargeable energy source.

19. A completion system, comprising:

a casing disposed in a wellbore;

a device disposed in the wellbore proximate the casing configured to perform a downhole operation; and an energy harvesting unit disposed in the well bore coupled to the device configured to harvest energy from an energy source in a downhole environment of the device and to provide the harvested energy to the device to perform the downhole operation, wherein the energy harvesting unit further comprises a first electrode configured to couple to a first formation layer having a first electrochemical potential and a second electrode configured to couple to a second formation layer having a second electrochemical potential different from the first electrochemical potential to obtain a current at the energy harvesting unit.

20. The completion system of claim 19, further comprising an energy storage unit that includes:

(i) at least one capacitor configured to accumulate a charge using the harvested energy, and (ii) (ii) a rechargeable energy source, wherein the at least one capacitor is further configured to recharge the rechargeable energy source.

21. A completion system, comprising:

a casing disposed in a wellbore;

a device disposed in the wellbore proximate the casing configured to perform a downhole operation; and an energy harvesting unit disposed in the wellbore coupled to the device configured to harvest energy from an energy source in a downhole environment of the device and to provide the harvested energy to the device to perform the downhole operation, wherein the energy harvesting unit further comprises a detector configured to receive radiation from a formation and produce an electric current in response to the received radiation.

22. The completion system of claim 21, further comprising an energy storage unit that includes:

(i) at least one capacitor configured to accumulate a charge using the harvested energy, and (ii) (ii) a rechargeable energy source, wherein the at least one capacitor is further configured to recharge the rechargeable energy source.

23. A completion system, comprising:

a casing disposed in a wellbore;

a device disposed in the wellbore proximate the casing configured to perform a downhole operation; and an energy harvesting unit disposed in the wellbore coupled to the device configured to harvest energy from an energy source in a downhole environment of the device and to provide the harvested energy to the device to perform the downhole operation, wherein the energy harvesting unit further comprises an induction coil configured to produce an electric current induced by an electromagnetic field resulting from at least one of: (i) a cathodic protection operation for a casing in the wellbore; and (ii) operation of an electrical instrument in the wellbore.

24. The completion system of claim 23, further comprising an energy storage unit that includes:

(i) at least one capacitor configured to accumulate a charge using the harvested energy, and (ii) a rechargeable energy source, wherein the at least one capacitor is further configured to recharge the rechargeable energy source.

* * * * *